US007809317B2

(12) United States Patent
Someya et al.

(10) Patent No.: US 7,809,317 B2
(45) Date of Patent: Oct. 5, 2010

(54) INTERMEDIATE TRANSFER DEVICE AND IMAGE FORMING APPARATUS

(75) Inventors: Yukimichi Someya, Saitama (JP); Misaki Shimizu, Komae (JP)

(73) Assignee: Ricoh Company Limited, Tokyo (JP)

( * ) Notice: Subject to any disclaimer, the term of this patent is extended or adjusted under 35 U.S.C. 154(b) by 141 days.

(21) Appl. No.: 12/186,906

(22) Filed: Aug. 6, 2008

(65) Prior Publication Data

US 2009/0041513 A1 Feb. 12, 2009

(30) Foreign Application Priority Data

Aug. 10, 2007 (JP) ..... 2007-210478
Sep. 13, 2007 (JP) ..... 2007-238580

(51) Int. Cl.
*G03G 15/16* (2006.01)

(52) U.S. Cl. ..... 399/307

(58) Field of Classification Search ..... 399/307, 399/302, 308, 328, 329, 334, 335; 219/619
See application file for complete search history.

(56) References Cited

U.S. PATENT DOCUMENTS 4,430,412 A * 2/1984 Miwa et al. ..... 430/124.1
5,361,126 A * 11/1994 Loonen et al. ..... 399/308
6,957,036 B2 10/2005 Kikuchi et al.
7,010,257 B2 3/2006 Someya et al.
7,031,648 B2 4/2006 Takashi et al.
7,127,202 B2 10/2006 Fujita et al.
7,139,520 B2 11/2006 Echigo et al.
7,177,580 B2 2/2007 Nakafuji et al.
7,233,762 B2 6/2007 Kunii et al.
7,254,362 B2 8/2007 Kikuchi et al.
7,269,384 B2 9/2007 Someya et al.
7,299,003 B2 11/2007 Kurotaka et al.
7,315,715 B2 1/2008 Tsuda et al.
7,333,760 B2 2/2008 Baba et al.
7,359,666 B2 4/2008 Takashi et al.
7,369,803 B2 5/2008 Echigo et al.
2005/0158075 A1 7/2005 Echigo et al.

(Continued)

FOREIGN PATENT DOCUMENTS

JP 2001-13798 1/2001

(Continued)

OTHER PUBLICATIONS

U.S. Appl. No. 10/571,914, filed Mar. 14, 2006, Masahiro Kurita, et al.

(Continued)

*Primary Examiner*—David P Porta
*Assistant Examiner*—Kiho Kim
(74) *Attorney, Agent, or Firm*—Oblon, Spivak, McClelland, Maier & Neustadt, L.L.P.

(57) ABSTRACT

An intermediate transfer device including an intermediate transfer member, an intermediate transfer part configured to transfer a toner image from an image bearing member onto the intermediate transfer member, a heating member configured to heat the intermediate transfer member to apply heat to the toner image thereon, a deformation member configured to apply pressure to the heated toner image on the intermediate transfer member, and a recording transfer part configured to transfer the compressed toner image from the intermediate transfer member onto a recording medium.

20 Claims, 10 Drawing Sheets

U.S. PATENT DOCUMENTS

| | | | | |
|---|---|---|---|---|
| 2005/0207801 | A1 * | 9/2005 | Kunii et al. | 399/307 |
| 2006/0013624 | A1 | 1/2006 | Kurotaka et al. | |
| 2006/0019082 | A1 | 1/2006 | Kikuchi et al. | |
| 2006/0034642 | A1 | 2/2006 | Nobuyuki | |
| 2006/0083555 | A1 | 4/2006 | Uchiyama et al. | |
| 2006/0088349 | A1 | 4/2006 | Someya et al. | |
| 2007/0025769 | A1 | 2/2007 | Someya et al. | |
| 2007/0071502 | A1 | 3/2007 | Shimizu | |
| 2007/0104520 | A1 | 5/2007 | Nakafuji et al. | |
| 2007/0231010 | A1 | 10/2007 | Ohta et al. | |

FOREIGN PATENT DOCUMENTS

| | | |
|---|---|---|
| JP | 3528371 | 3/2004 |
| JP | 2005-266304 | 9/2005 |
| JP | 2006-195344 | 7/2006 |
| JP | 2006-195429 | 7/2006 |

OTHER PUBLICATIONS

U.S. Appl. No. 11/406,267, filed Apr. 19, 2006, Naomi Sugimoto, et al.
U.S. Appl. No. 11/693,417, filed Mar. 29, 2007, Someya Yukimichi, et al.
U.S. Appl. No. 12/033,155, filed Feb. 19, 2008, Fujita Takashi, et al.
U.S. Appl. No. 12/108,786, filed Apr. 24, 2008, Misaki Shimizu, et al.
U.S. Appl. No. 12/123,040, filed May 19, 2008, Takuma Nakamura, et al.

* cited by examiner

INTERMEDIATE TRANSFER DEVICE AND IMAGE FORMING APPARATUS

CROSS-REFERENCE TO RELATED APPLICATIONS

This document claims priority from and contains subject matter related to Japanese Patent Application Nos. 2007-210478 and 2007-238580, filed on Aug. 10, 2007 and Sep. 13, 2007, respectively, the entire contents of each of which are hereby incorporated herein by reference.

BACKGROUND

1. Field of the Invention

The present invention relates to an intermediate transfer device that transfers a toner image from an image bearing member onto a recording medium using an intermediate transfer member, and to an image forming apparatus using the intermediate transfer device.

2. Description of the Background

In a typical image forming apparatus, single-color toner images of different colors are sequentially formed on an image bearing member and sequentially transferred onto an intermediate transfer member so that a full-color toner image (hereinafter "toner image") in which the single-color toner images are superimposed on one another is formed. The toner image is then transferred from the intermediate transfer member onto a recording medium, and the recording medium having the toner image there on is conveyed to a fixing device so that the toner image is melted onto the recording medium.

Alternatively, the toner image on the intermediate transfer member may be simultaneously transferred and fixed onto a recording medium at a nip formed between the intermediate transfer member and a pressing member.

Typically, when a toner image is fixed on a recording medium such as paper by application of heat and pressure, the toner image deforms along microscopic concavities and convexities formed on the surface of the recording medium due to the presence of fibers.

The degree of deformation of the toner image varies by location on the surface, and therefore, a toner image fixed on a rough-surfaced recording medium can appear grainy. In particular, a toner image formed on a concave portion deforms much less when fixed thereon because the toner image is not in contact with a pressing member or a pressing force applied to the toner image from the pressing member is small. Therefore, there is a difference in surface texture between toner images fixed on convex portions and concave portions, resulting in uneven gloss in the fixed toner image.

However, a problem is that a toner image on an intermediate transfer member is heated and compressed from a toner image side. Typically, surface layers of the heating members (e.g., heating roller, integrating means) and the intermediate transfer members include a release material to facilitate reliable separation of a toner image from the heating member. As the release material, fluorocarbon resins such as PFA (tetrafluoroethylene-perfluoroalkyl vinyl ether copolymer) and PTFA (tetrafluoroethylene copolymer) are typically used.

On the other hand, when a toner image is heated by the heating member in contact with the toner image, toner particles on the heating member side may have higher temperature than those on the recording medium side. Therefore, the toner particles on the heating member side may be easily melted and deformed. As a result, the melted toner particles tend to adhere to the heating member, thereby causing an offset problem in which the adhered toner particles are retransferred onto the recording medium. It is difficult to prevent the occurrence of the offset problem even if the type (i.e., surface energy) of releasing material is varied.

In addition, fixing performance largely depends on the nature of the surface of the recording medium. Specifically, when the recording medium has a rough surface, the toner image needs to be heated to have a low viscosity or a pressure applied to the recording medium at a transfixing area needs to be increased, so that the toner image anchors in the fibers of the recording medium.

To reduce viscosity, the toner image needs to be heated to a higher temperature with concern of the occurrence of the offset problem. As the temperature of the toner image increases, that of the intermediate transfer member also increases. Further, the heat may transfer to an image bearing member and increase the temperature thereof.

As a result, the temperatures of other devices and members provided adjacent to the image bearing member also increase. Consequently, toner particles contained in a developing device or a cleaning device may be aggregated on or adhered to the device, which is undesirable.

Moreover, when a greater pressure is applied at the transfixing area, components constituting the transfixing area and the intermediate transfer member need to be very durable, resulting in cost increase.

To overcome the problems described above, JP-A-2001-13798 discloses an image forming apparatus in which a toner image on an intermediate transfer member is heated from an intermediate transfer member side.

The image forming apparatus may further include a deformation member to deform the toner image on the intermediate transfer member from a toner image side before being transferred onto the recording medium. When the intermediate transfer member is heated to a higher temperature than the deformation member, the toner image may strongly adhere to the intermediate transfer member, thereby preventing toner particles from adhering to the deformation member.

However, it is difficult to keep the temperature of the deformation member lower than that of the intermediate transfer member constantly. Therefore, toner particles adhered to the deformation member may be retransferred onto the recording medium, resulting in production of abnormal images.

SUMMARY

Accordingly, example embodiments of the present invention provide an intermediate transfer device that can produce high quality images, having high image density and even glossiness, regardless of surface roughness of a recording medium. Such an intermediate transfer device evenly transfers a toner image onto a recording medium without adversely affecting performances of other devices and components. Further, such an intermediate transfer device has high durability and consumes less energy, resulting in energy saving and low cost.

These and other features and advantages of the present invention, either individually or in combinations thereof, as hereinafter will become more readily apparent, can be attained by example embodiments described below.

One example embodiment provides an intermediate transfer device including an intermediate transfer member; an intermediate transfer part configured to transfer a toner image from an image bearing member onto the intermediate transfer member; a heating member configured to heat the intermediate transfer member to apply heat to the toner image thereon; a deformation member configured to apply pressure to the heated toner image on the intermediate transfer member; and a recording transfer part configured to transfer the compressed toner image from the intermediate transfer member onto a recording medium.

Another example embodiment provides an image forming apparatus including an image bearing member configured to bear a toner image; the intermediate transfer device described above; and a heating device configured to heat the recording medium having the toner image thereon.

Yet another example embodiment provides an intermediate transfer device including an intermediate transfer member onto which a toner image is transferred, which is movable; a heating member configured to apply heat to the toner image on the intermediate transfer member; a deformation member configured to apply pressure to the heated toner image on the intermediate transfer member to deform the toner image, which is rotatable; and an excessive heat transfer member configured to transfer excessive heat from the deformation member.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION

Figure 1:
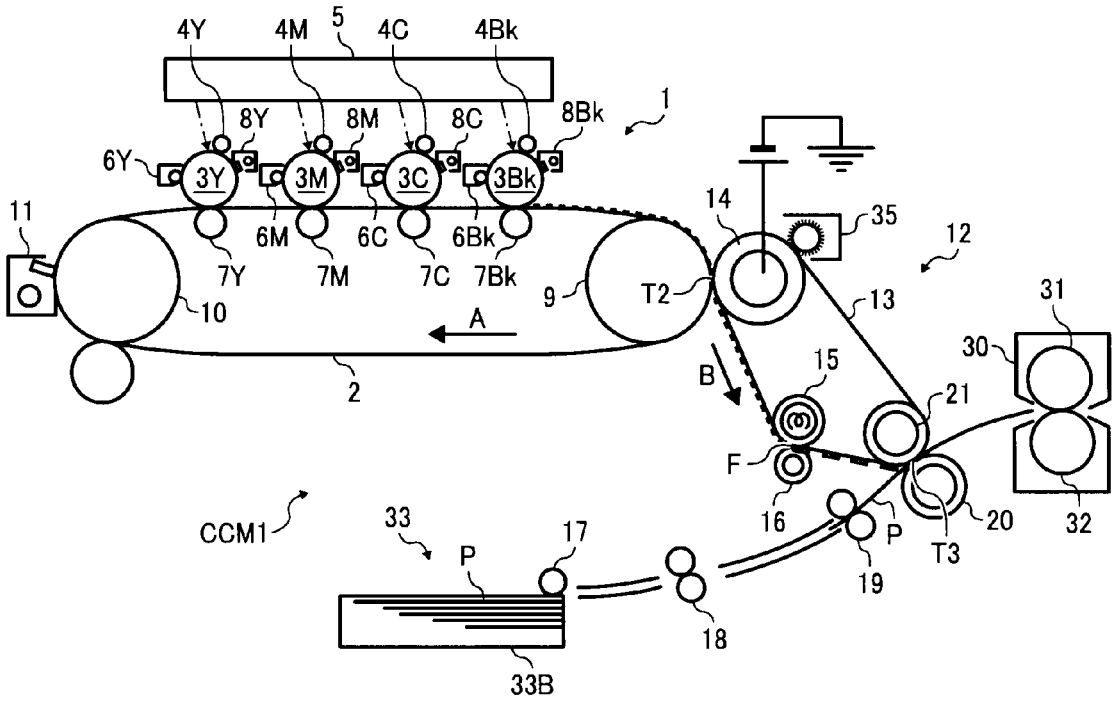
FIG. 1 is a schematic view illustrating an example embodiment of an image forming apparatus of the present invention.

Example embodiments will now be described in detail referring to the drawings, wherein like reference numerals designate identical or corresponding parts throughout the several views thereof.

FIG. 1 is a schematic view illustrating a tandem color copier as an example embodiment of an image forming apparatus of the present invention.

A tandem color copier CCM1 illustrated in FIG. 1 includes an image forming part 1 in the central part, an intermediate transfer device 12, and a paper feed part 33 beneath the intermediate transfer device 12. The image forming part 1 includes an intermediate transfer belt 2 having a transfer surface stretched in a horizontal direction. The intermediate transfer belt 2 is stretched taut by a driving roller 9 and a driven roller 10, and is rotatable in a direction indicated by arrow A in FIG. 1.

Above the transfer surface of the intermediate transfer belt 2, drum-shaped photoconductors (i.e., image bearing members) 3Y, 3M, 3C, and 3Bk are arranged at specific intervals along a direction of movement of the intermediate transfer belt 2. Toner images of yellow, magenta, cyan, and black, which are complementary colors of color separation colors, are respectively formed on the photoconductors 3Y, 3M, 3C, and 3Bk (hereinafter "photoconductors 3" unless otherwise specified).

The photoconductors 3 are rotatable in the same direction, i.e., counterclockwise in FIG. 1. Charging devices 4Y, 4M, 4C, and 4Bk (hereinafter "charging devices 4"), a writing device 5, developing devices 6Y, 6M, 6C, and 6Bk (hereinafter "developing devices 6"), primary transfer rollers 7Y, 7M, 7C, and 7Bk (hereinafter "primary transfer rollers 7"), and cleaning devices 8Y, 8M, 8C, and 8Bk (hereinafter "cleaning devices 8") are provided around the photoconductors 3, respectively.

Each developing device 6 contains a toner having a color corresponding to a color of a latent image to be developed. A belt cleaning device 11 to clean the surface of the intermediate transfer belt 2 is provided so as to face the driven roller 10.

The intermediate transfer device 12, configured to perform secondary intermediate transfer, is provided facing the driving roller 9. A secondary transfer roller 14 is provided so that a secondary transfer area T2 is formed between the intermediate transfer belt 2 and a secondary intermediate transfer belt 13. A voltage is applied to the secondary transfer roller 14 so that an electric field is formed between the secondary transfer roller 14 and the driving roller 9 to transfer a toner image.

The secondary intermediate transfer belt 13 is stretched taut by the secondary transfer roller 14, a recording transfer roller 21, and a heating roller 15, and is rotatable in a direction indicated by arrow B in FIG. 1. A pressing roller 20 is provided so as to face the recording transfer roller 21 with the secondary intermediate transfer belt 13 therebetween. A pressing member, not shown, presses the pressing roller 20 against the recording transfer roller 21 to form a recording transfer area T3 therebetween, at which a toner image is transferred onto a recording medium P.

A cleaning device 35 is provided on a downstream side from the recording transfer area T3 and an upstream side from the secondary transfer area T2 relative to a direction of rotation of the secondary intermediate transfer belt 13, so as to face the secondary transfer roller 14 with the secondary intermediate transfer belt 13 therebetween. A deformation roller 16 to deform a toner image is provided so as to face the heating roller 15 containing a heater with the secondary intermediate transfer belt 13 therebetween.

A pressing member, not shown, presses the deformation roller 16 against the heating roller 15 to form a deformation area F therebetween on a downstream side from a contact starting point of the secondary intermediate transfer belt 13 with the heating roller 15 relative to a direction of rotation of the secondary intermediate transfer belt 13. In the recording transfer area T3, pressing force is set to from 1 to 5 kgf/cm$^2$. In the deformation area F, pressing force is set to from 0.5 to 3 kgf/cm$^2$.

The recording medium P stored in a paper feed cassette 33B in the paper feed part 33 is conveyed to the recording transfer area T3 by a paper feed roller 17, a pair of conveyance rollers 18, and a pair of registration rollers 19. The recording medium P is then conveyed to a fixing device 30.

The fixing device 30 includes a fixing roller 31 and a pressing roller 32. The fixing roller 31 contains a halogen heater, not shown. The pressing roller 32 is provided so as to face and press the fixing roller 31. The fixing roller 31 is controlled to have a predetermined or desired temperature. Heat and pressure are applied to the recording medium P having a toner image thereon at a nip formed between the fixing roller 31 and the pressing roller 32.

The fixing roller 31 includes a metallic cored bar and an elastic layer formed thereon. In the present embodiment, an elastic layer made of a silicone rubber having a thickness of from 0.1 to 0.5 mm is provided. Further, the fixing roller 31 may have a surface layer made of a fluorocarbon resin, or a release agent such as silicone oil may be applied to the surface thereof, to improve releasability. In the present embodiment, a PFA tube having a thickness of 10 μm is used for the surface layer, so that the surface layer has a low hardness.

Although the elastic layer made of a silicone rubber has a low hardness, a combination with a thin surface layer made of a fluorocarbon resin is preferable from the viewpoint of improving durability. The term "hardness" here means "microhardness". For example, the layer preferably has a universal hardness of 1 N/cm$^2$ or less at an indentation depth of 20 μm, corresponding to the surface roughness of a recording medium (i.e., paper), at working temperatures, so that a thin toner layer precisely follows microscopic concavities and convexities in the recording medium.

At a time the color copier CCM1 starts a full-color image forming operation, the surface of the photoconductor 3Y is evenly charged by the charging device 4Y. The charged surface of the photoconductor 3Y is irradiated with a light beam emitted from the writing device 5, based on image information transmitted from an image reading part, thereby forming an electrostatic latent image corresponding to a yellow image.

The electrostatic latent image thus formed is developed with a yellow toner contained in the developing device 6Y to form a yellow toner image. The yellow toner image is transferred in a so-called primary transfer process onto the intermediate transfer belt 2 by the primary transfer roller 7Y to which a predetermined bias is applied.

Similarly, magenta, cyan, and black toner images are formed on the photoconductors 3M, 3C, and 3Bk, respectively. Each toner image is successively transferred onto the intermediate transfer belt 2 and super imposed on one another. Residual toner particles remaining on the photoconductors 3 after the toner images are primarily transferred therefrom are removed by the cleaning devices 8.

Subsequently, each of the photoconductors 3 is decharged by a decharging unit, not shown, so as to prepare for the next image forming operation. A composite toner image (hereinafter simply "toner image"), in which toner images of each color are superimposed one another, primarily transferred onto the intermediate transfer belt 2, is then transferred onto the secondary intermediate transfer belt 13 at the secondary transfer area T2 due to a bias applied thereto in a so-called secondary transfer process.

The secondary intermediate transfer belt 13 is rotated by a motor, not shown, in a direction indicated by arrow B in FIG. 1, so that the recording transfer roller 21 is driven to rotate. The toner image is heated by heat from the secondary intermediate transfer belt 13 heated by the heating roller 15, and then compressed by the deformation roller 16 in the deformation area F. As a result, the toner image is deformed and a toner area ratio, which is a ratio of an area to which toner particles are adhered to a total image area, is increased.

The recording medium P is fed from the paper feed cassette 33B in synchronization with entry of the deformed toner image into the recording transfer area T3. The heated and deformed toner image is pressed against the recording medium P in the recording transfer area T3 so that the toner image is transferred onto the recording medium P. The recording medium P onto which the toner image is transferred is then conveyed to a nip formed between the fixing roller 31 and the pressing roller 32 in the fixing device 30 so that the toner image is fixed on the recording medium P.

The secondary intermediate transfer belt 13 may have a double-layered structure. In the present embodiment, an inner substrate layer made of a polyimide resin having a thickness of from 60 to 100 μm and an outer elastic layer made of a silicone rubber having a thickness of from 0.05 to 0.5 mm are provided.

Since the secondary intermediate transfer belt 13 is heated from an inner surface thereof, heating efficiency increases as the layers become thinner over time. Providing the elastic layer helps the deformed toner image to precisely follow the surface roughness of the recording medium P when transferred thereon at the recording transfer area T3, resulting in improved transfer performance.

By heating the secondary intermediate transfer belt 13 from an inner surface thereof, the secondary intermediate transfer belt 13 can be reliably heated to higher temperatures.

Accordingly, the toner image is prevented from adhering to the deformation roller 16. Specifically, when the secondary intermediate transfer belt 13 is heated, heat is immediately transferred to the toner image, not to other components.

For the above reason, the secondary intermediate transfer belt 13 can be thinner. Accordingly, the surface of the toner image is easily heated. In addition, heat capacity of the secondary intermediate transfer belt 13 can be reduced, and therefore the temperature thereof is easily decreased when contacting the recording medium. Accordingly, heat is prevented from transferring to other components provided on downstream sides.

To transfer a toner image, which has been deformed into a thin layer, onto a rough-surfaced recording medium having a surface roughness Rz of 50 μm, pressing force at the recording transfer area T3 may be increased or the secondary intermediate transfer belt 13 may be heated more to soften the toner image.

However, greater pressing force may degrade durability of components, while excessive heating may waste a large amount of energy. Further, in the latter case, the secondary intermediate transfer belt 13 may not be sufficiently cooled because heat does not sufficiently transfer to the recording medium P while the secondary intermediate transfer belt 13 is conveyed to the secondary transfer area T2 again. Consequently, heat is transmitted to the intermediate transfer belt 2 and the image forming part 1, resulting in image distortion and toner blockage.

For the above reasons, the surface layer of the secondary intermediate transfer belt 13 preferably includes a member capable of conforming to surface roughness of the recording medium P. An ability of the member to conform to surface roughness of the recording medium P can be represented by surface hardness. The universal hardness, which is a microscopic hardness, is suitable for representing the surface hardness, while a typical surface hardness such as JIS hardness is unsuitable because the measurement area is larger than intervals of fibers of the recording medium P. The surface layer of the secondary intermediate transfer belt 13, which contacts the recording medium P, preferably has a surface hardness of HU 1.0 $N/mm^2$ or less at an indentation depth of 20 μm.

The surface layer of the secondary intermediate transfer belt 13 may also be formed using a tube having a thickness of from 5 to 20 μm including a fluorocarbon resin such as PFA (tetrafluoroethylene-perfluoroalkyl vinyl ether copolymer) and PTFE (tetrafluoroethylene copolymer), to provide reliable separability and to prevent deterioration thereof.

In the present embodiment, the fixing device 30 employs a fixing roller, which is one contact heating means. Alternatively, an atmosphere heater, which is one non-contact heating means, may be employed in the fixing device 30. A detailed description of the structure and operation of such an atmosphere heater is given below.

Although a toner image is evenly deformed in the deformation area F in advance, the toner image may further deform unevenly when fixed on the recording medium P by application of heat using the contact heating means, because of conforming to surface roughness of the recording medium P. To prevent the uneven deformation of toner image, non-contact heating means are preferably used. In this case, the resultant image quality may be equivalent to that of an image formed on a smooth recording medium.

Figure 2:
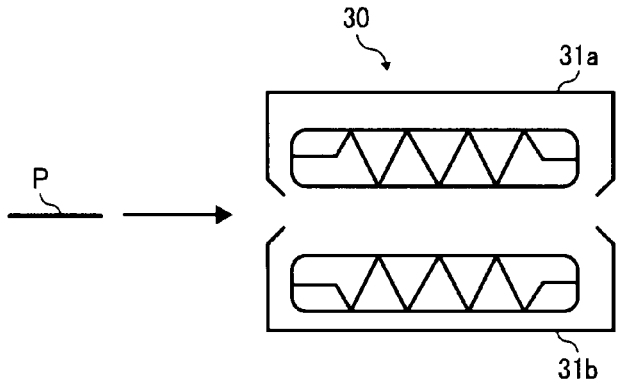
FIG. 2 is a schematic view illustrating an embodiment of an atmosphere heater, which is one of non-contact heating means.

FIG. 2 is a schematic view illustrating an embodiment of an atmosphere heater, which is one of non-contact heating means. In FIG. 2, the fixing device 30 includes a pair of heaters 31*a* and 31*b*. The recording medium P is conveyed to between the pair of heaters 31*a* and 31*b* as indicated by an arrow in FIG. 2.

Each of the pair of heaters 31*a* and 31*b* includes a heat reflection plate and an infrared heater. The heaters 31*a* and 31*b* are provided so as to face upper and lower surfaces of the recording medium P, respectively, but not in contact therewith. Electricity is provided from a power source, not shown, to each of the pair of heaters 31*a* and 31*b* so as to heat the recording medium P to from 100 to 120° C. The recording medium P is conveyed by a conveyance unit, not shown.

For example, the conveyance unit may include grip members for gripping edges of the recording medium P and guide plates for conveying the grip members, so that the recording medium P is conveyed along the guide plates. As another example, the conveyance unit may include several wires which are driven, so that the recording medium P putting thereon is conveyed. Alternatively, a thin conveyance member such as a conveyance belt may be provided in the fixing device so as to face a backside of the recording medium P. In each case described above, it is preferable that the conveyance unit and/or member never contact an unfixed toner image.

Figure 3:
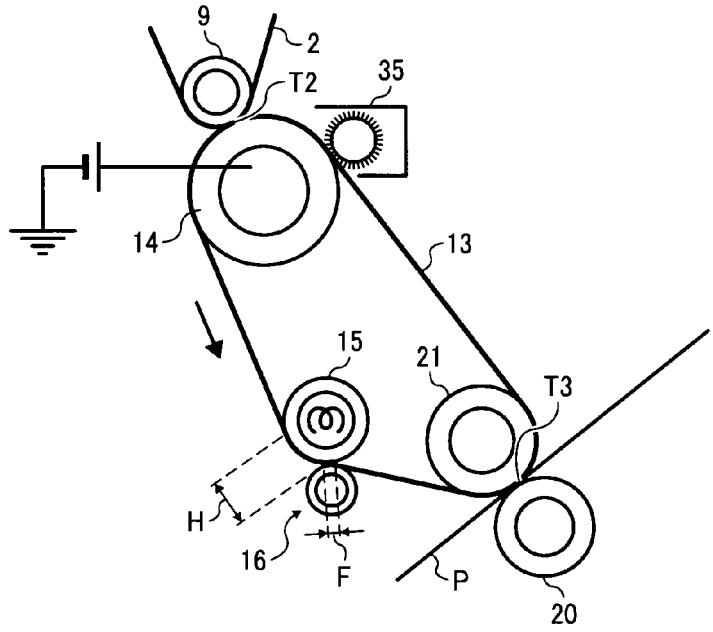
FIG. 3 is a schematic view illustrating a first example embodiment of the intermediate transfer device used for the image forming apparatus illustrated in FIG. 1.

FIG. 3 is a schematic view illustrating a first example embodiment of the intermediate transfer device 12 used for the color copier CCM1 illustrated in FIG. 1. The deformation roller 16 is a metallic cored bar, the surface of which is covered with a layer including fluorocarbon resins such as PFA (tetrafluoroethylene-perfluoroalkyl vinyl ether copolymer) and PTFA (tetrafluoroethylene copolymer).

The secondary intermediate transfer belt 13 contacts the heating roller 15 so as to form a heating area H therebetween on an upstream side from the deformation roller 16 relative to a direction of rotation of the secondary intermediate transfer belt 13. The secondary intermediate transfer belt 13 is heated from an inner side thereof while rotating, thereby heating a toner image thereon. Subsequently, the toner image is deformed in the deformation area F by application of heat and pressure from the deformation roller 16 and the heating roller 15.

The heating area H preferably has an area large enough to transmit heat from an inner surface to an outer surface of the secondary intermediate transfer belt 13. Accordingly, the toner image can be heated to a softening temperature thereof so as to be satisfactorily and effectively deformed. The deformation roller 16 is preferably provided facing a point of maximum temperature on the outer surface of the secondary intermediate transfer belt 13.

The toner image can be reliably pressed by the heating roller 15 and the deformation roller 16, which are facing each other. Accordingly, the toner image can be reliably deformed, resulting in production of high quality images.

At this time, a surface of the toner image contacting the secondary intermediate transfer belt 13 has a higher temperature than that contacting the deformation roller 16. Therefore, toner particles near the secondary intermediate transfer belt 13 deform heavily when the toner image is compressed in the deformation area F. Accordingly, the adherence of the toner image to the secondary intermediate transfer belt 13 is greater than that to the deformation roller 16. As a result, the toner image is prevented from adhering to the deformation roller 16 when deformed in the deformation area F, preventing production of abnormal images.

Further, the surface layer of the deformation roller 16 is much rougher than that of the secondary intermediate transfer belt 13. Accordingly, the toner image strongly adheres to the secondary intermediate transfer belt 13 compared to the deformation roller 16. As a result, the toner image is prevented from adhering to the deformation roller 16.

In addition, when the total surface roughness of the secondary intermediate transfer belt 13 and the deformation roller 16 is smaller than the particle diameter of the toner, the toner image can be much more consistently deformed.

The toner image deformed in the deformation area F is conveyed to the recording transfer area T3 and pressed against the recording medium P, so that the toner image is transferred onto the recording medium P. Since the toner image has been previously partially melted (softened) at an upstream side from the recording transfer area T3, there is an advantage that the toner image can readily adhere to the recording medium P.

It is advantageous to shorten a travel time of the toner image from the deformation area F to the recording transfer area T3 so that the toner image loses less heat, because the more constant the temperature of the toner image, the more easily it can adhere to the recording medium P.

The deformation area F and the heating area H are provided on a downstream side from the secondary transfer area T2 and an upstream side from the recording transfer area T3 relative to a direction of rotation of the secondary intermediate transfer belt 13, much closer to the recording transfer area T3. Since the heating area H is provided on an upstream side from the recording transfer area T3, heat is sufficiently radiated at downstream sides from the recording transfer area T3 and upstream sides from the secondary transfer area T2, resulting in prevention of heat transfer.

The secondary intermediate transfer belt 13 has a less surface hardness than the deformation roller 16, thereby increasing deformation efficiency of the toner images. In other words, the deformed toner image has a higher toner area ratio with a less toner, resulting in reduction of both cost and toner usage.

Figure 4:
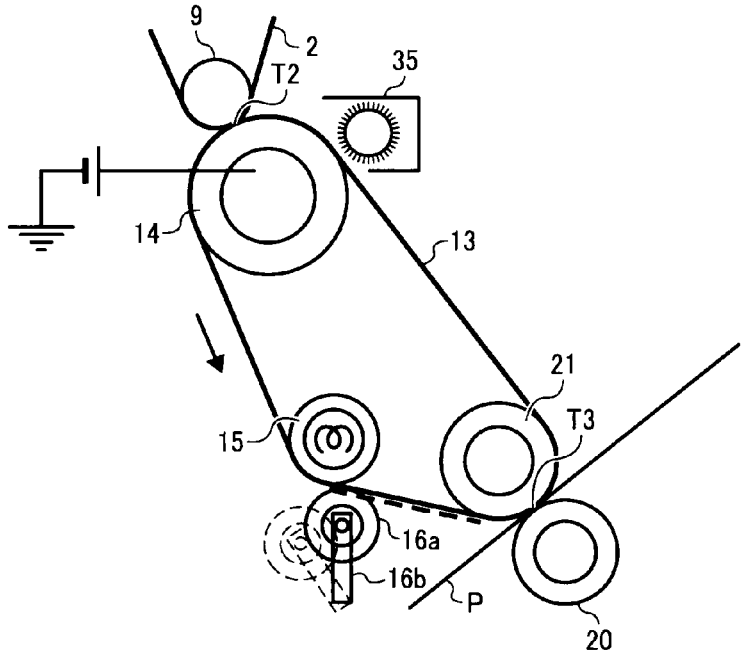
FIG. 4 is a schematic view illustrating a second example embodiment of the intermediate transfer device used for the image forming apparatus illustrated in FIG. 1.

FIG. 4 is a schematic view illustrating a second example embodiment of the intermediate transfer device 12 used for the color copier CCM1 illustrated in FIG. 1. The deformation roller 16 in the first example embodiment shown in FIG. 3 is replaced with a rotatable member 16*a* and a support member 16*b* in the second example embodiment shown in FIG. 4. One end of the support member 16*b* rotatably supports the rotatable member 16*a*, and the other end is rotatably supported by another member, not shown.

A spring, not shown, presses the support member 16*b* so that the rotatable member 16*a* contacts the secondary intermediate transfer belt 13 with a predetermined pressure. The support member 16*b* is rotatable so that the rotatable member 16*a* is apart from the secondary intermediate transfer belt 13. The support member 16*b* is driven to rotate by a driving source, not shown.

The rotatable member 16*a* is controlled to be separated from the secondary intermediate transfer belt 13 while image formation is not performed. It is preferable that no toner image is on the secondary intermediate transfer belt 13 when no sheets of the recording medium P is conveyed or the secondary intermediate transfer belt 13 stops rotating.

In the present embodiment, the rotatable member 16*a* is prevented from being heated by heat from the secondary intermediate transfer belt 13. As a result, the temperature difference between the rotatable member 16*a* and the secondary intermediate transfer belt 13 is kept constant. Accordingly, a toner image is prevented from adhering to the rotatable member 16*a* in the deformation area F.

Generally, the amount of toner required for producing a toner image is decided by a desired reflection image density (hereinafter simply "image density"). In addition, the resultant image density varies depending on the kind of recording medium used, even if the amount of toner is same. Specifically, the resultant image density depends on surface roughness of a recording medium. The greater the surface roughness of recording medium, the greater amount of toner required.

When a toner image is transferred onto a rough-surfaced recording medium, toner particles tend to get into concave portions of the recording medium. Therefore, a 100% solid image may have a smaller toner area ratio, which is a ratio of an area to which toner particles are adhered to a total image area.

The toner image transferred onto the recording medium is then fixed thereon by a fixing device. Accordingly, the toner area ratio slightly increases. However, only toner particles transferred onto convex portions of the recording medium are compressed and deformed, resulting in a smaller deformation of the toner image. Therefore, the toner image needs to include a greater amount of toner particles to obtain a desired image density on the rough-surfaced recording medium.

For example, when a 100% solid image including toner particles in an amount of 0.4 mg/cm$^2$ is transferred onto a recording medium having a high smoothness (i.e., Rz=2 μm), with toner particles having an average particle diameter of 6 μm, the transferred image has a toner area ratio of 90%.

By contrast, the transferred image has a toner area ratio of 80% when transferred onto a recording medium having a low smoothness (i.e., Rz=50 μm). When the transferred image is fixed on the above-described recording media each having a high and a low smoothness, the fixed solid image has a toner area ratio of 97% and 82%, respectively. The recording media having a low smoothness needs toner particles in an amount of 0.5 mg/cm$^2$ to obtain a desired image density.

In the foregoing example embodiments, a toner image is previously heated and softened before being pressed and deformed by a smooth member in the deformation area F. Accordingly, the toner image is evenly compressed, resulting in consistent deformation of the toner image. In this case, less toner is required to obtain a desired toner area ratio. In addition, the resultant image density does not depend on the kind of recording medium used.

The surface layer of the secondary intermediate transfer belt 13 has a relatively low hardness so that the toner image is effectively transferred in the recording transfer area T3.

Further, the surface layer of the deformation roller 16 has a higher hardness than the secondary intermediate transfer belt 13, and therefore the toner image may more effectively deform. As a result, less toner is required to obtain a desired toner area ratio.

As described above, a toner image is previously deformed by application of heat and pressure so that the toner area ratio increases after the toner image is transferred in the recording transfer area T3. On the other hand, the smaller the particle diameter of toner, the greater the toner area ratio after transfer in the secondary transfer area T2. Accordingly, less heat and pressure may be required to deform the toner image as the particle diameter of toner decreases, resulting in energy saving, prevention of heat transfer to the image forming part, and longer component life.

By keeping the deformation ratio constant, toner usage may be reduced. However, as the particle diameter of toner becomes smaller, the deformed toner image becomes thinner. In this case, the toner image contacts the recording medium over a smaller area. Therefore, transfer performance may deteriorate when the recording medium has a rough surface. Preferably, the particle diameter of toner is from 2 to 10 μm.

Referring back to FIG. 4, movement of the rotatable member 16*a* and the support member 16*b* may be controllable according to the kind of recording medium, so that the toner area ratio can be kept constant regardless of the kind of recording medium. For example, the rotatable member 16*a* may be controlled to deform a toner image when the recording medium has a rough surface, but not to deform a toner image when the recording medium has a smooth surface. In this case, toner usage can be reduced even if the recording medium has a rough surface, because the same amount of toner is consumed regardless of the kind of recording medium.

In addition, the support member 16*b* may rotate at multiple angles so that deformation time and pressing force of the rotatable member 16*a* are variable. Specifically, the contact area of the rotatable member 16*a* with the secondary intermediate transfer belt 13 increases as the rotation angle of the support member 16*b* increases. Such a configuration provides reliable imaging regardless of the kind of recording medium.

Further, image glossiness can be also controlled by controlling the deformation ratio. As the deformation ratio increases, the toner image transferred onto the recording medium has smoother surface, resulting in highly glossy images.

In the first and second example embodiments described above, a toner image transferred onto the secondary intermediate belt 13 is deformed into a thin layer by the deformation roller 16. The height and area of the deformed toner image change little even after the deformed toner image is transferred onto the recording medium P, the surface of which has microscopic concavities and convexities due to the presence of fibers. Accordingly, the area of the toner image varies little if at all, regardless of the kind of recording medium. The toner image transferred onto the recording medium P is then conveyed to the fixing device 30.

Figure 5A:
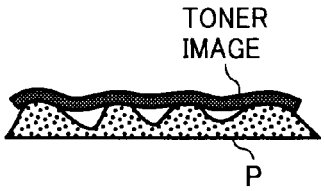
FIG. 5A is a schematic view illustrating a toner image transferred onto a rough-surfaced recording medium.
Figure 5B:
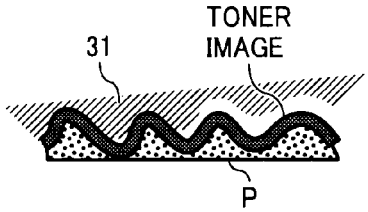
FIG. 5B is a schematic view illustrating a toner image transferred onto a rough-surfaced recording medium and heated.
Figure 5C:
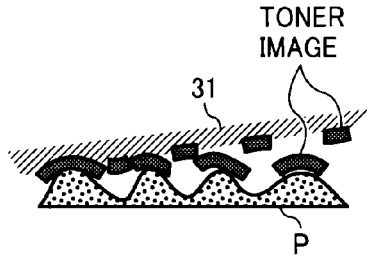
FIG. 5C is a schematic view illustrating a toner image transferred onto a rough-surfaced recording medium when contacting a fixing roller having a surface layer having a high hardness.

FIG. 5A is a schematic view illustrating a toner image transferred onto a rough-surfaced recording medium. FIG. 5B is a schematic view illustrating a toner image transferred onto a rough-surfaced recording medium and heated. FIG. 5C is a schematic view illustrating a toner image transferred onto a rough-surfaced recording medium when contacting a fixing roller having a surface layer having a high hardness.

Glossiness of an image largely depends on surface smoothness of the image. In FIG. 5A, the toner image has a high glossiness because of having a smooth surface.

In FIG. 5B, the toner image conforms to the surface roughness of the recording medium P by application of heat from the fixing roller 31. As a result, the toner image has a low glossiness because of having a rough surface.

In FIG. 5C, part of the toner image adheres to the fixing roller 31 when heated, thereby causing image defect. Since the surface layer of the fixing roller 31 has a high hardness, the fixing roller 31 hardly conforms to the surface roughness of the recording medium P. Consequently, the toner image unevenly contacts the recording medium P and part of the toner image adheres to the fixing roller 31 when heated and melted by the fixing roller 31.

As described above, when a toner image is previously deformed by a smooth member before being transferred onto a recording medium, the transferred toner image may have a high glossiness because of having a smooth surface regardless of surface roughness of the recording medium, as shown in FIG. 5A. Therefore, when the toner image is transferred onto a rough-surfaced recording medium, there may be a large difference in glossiness between image portions and background portions.

On the other hand, when the transferred toner image conforms to surface roughness of a recording medium, as shown in FIG. 5B, glossiness of the toner image may decrease corresponding to surface roughness of the recording medium.

Accordingly, an image forming apparatus in which a toner image is previously deformed before being transferred onto a recording medium produces highly glossy images. When such an image forming apparatus further includes a heating device to heat the transferred image, glossiness of the toner image may correspond to surface roughness of the recording medium. By controlling heating of the heating device, glossiness of the toner image may be controlled.

The surface roughness of the secondary intermediate transfer belt 13 is not as great as that of the deformation roller 16. Therefore, a toner image tends to adhere to the secondary intermediate transfer belt 13 having a smoother surface when heated, resulting in prevention of the toner image from adhering to the deformation roller 16.

In the foregoing example embodiments, a deformed toner image is transferred onto a recording medium, and subsequently fixed thereon in another process. Alternatively, however, a deformed toner image may be transferred and fixed onto a recording medium simultaneously.

In the foregoing example embodiments, the secondary intermediate transfer belt 13 is heated by a heater contained in the heating roller 15 in contact with an inner surface of the secondary intermediate transfer belt 13. Alternatively, however, any other heating method capable of heating the secondary intermediate transfer belt 13 is also applicable.

Figure 6:
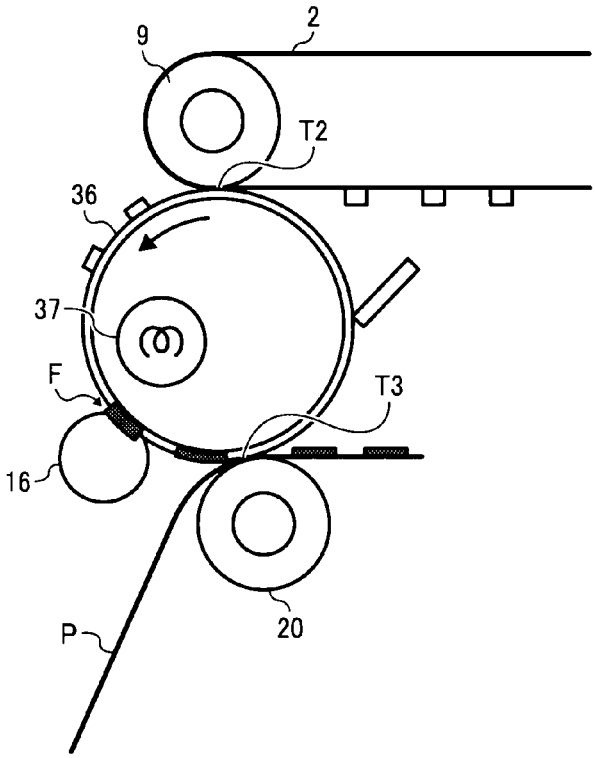
FIG. 6 is a schematic view illustrating a third example embodiment of the intermediate transfer device used for the image forming apparatus illustrated in FIG. 1.

FIG. 6 is a schematic view illustrating a third example embodiment of the intermediate transfer device 12 used for the color copier CCM1 illustrated in FIG. 1, which contains a heater configured to heat a secondary intermediate transfer member.

In FIG. 6, the secondary intermediate transfer member includes a roller 36 and a heater 37 provided inside the roller 36. The heater 37 is provided nearest a surface (hereinafter "toner moving surface") of the roller 36 extending from the secondary transfer area T2 toward the recording transfer area T3, on which a toner image moves, and on an upstream side from the deformation area F relative to a direction of rotation of the roller 36.

Figure 7:
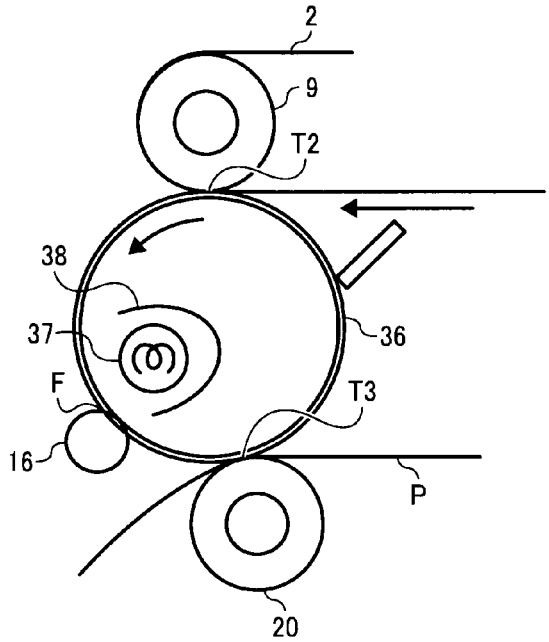
FIG. 7 is a schematic view illustrating a fourth example embodiment of the intermediate transfer device used for the image forming apparatus illustrated in FIG. 1.

FIG. 7 is a schematic view illustrating a fourth example embodiment of the intermediate transfer device 12 used for the color copier CCM1 illustrated in FIG. 1, which contains a heater configured to heat a secondary intermediate transfer member.

In FIG. 7, a reflecting plate 38 is further provided so that one side of the heater 37 is covered. This configuration enables the roller 36 to be maximally heated at an upstream side from the deformation area F relative to a direction of rotation of the roller 36, and to effectively heat a toner image. Since the heater 37 hardly heats a surface of the roller 36 extending over downstream sides from the recording transfer area T3 relative to a direction of rotation of the roller 36, there is an advantage that components provided around the secondary transfer area T2 are hardly heated.

The roller 36 comprises a metallic substrate and an elastic layer made of silicone. A release layer, such as a fluorocarbon resin layer, may be further provided on the elastic layer. A toner image can be reliably deformed in the deformation area F formed between the deformation roller 16 and the roller 36. Therefore, no component to face the deformation roller 16 is needed, resulting in cost reduction.

Figure 8:
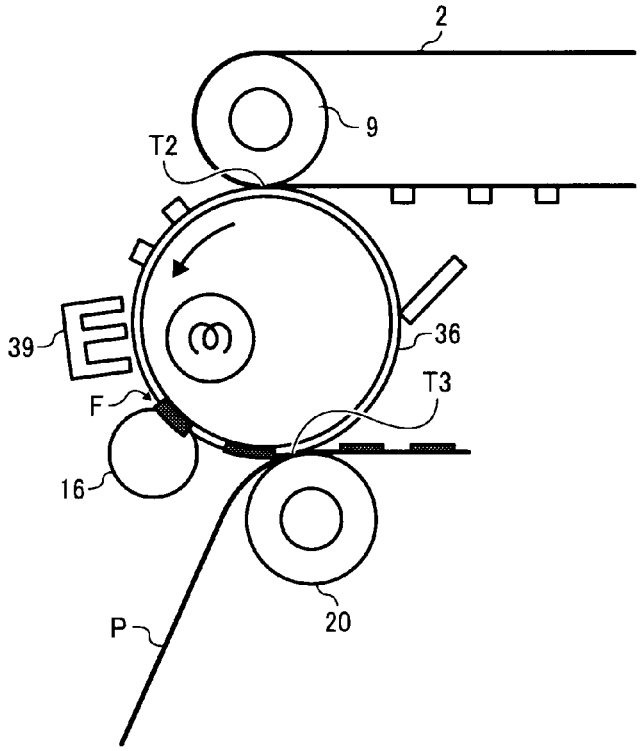
FIG. 8 is a schematic view illustrating a fifth example embodiment of the intermediate transfer device used for the image forming apparatus illustrated in FIG. 1.

FIG. 8 is a schematic view illustrating a fifth example embodiment of the intermediate transfer device 12 used for the color copier CCM1 illustrated in FIG. 1, which contains an induction heater configured to heat a secondary intermediate transfer member.

In FIG. 8, an induction heater 39 is provided on an outer side of the roller 36, so as to heat a point downstream from the secondary transfer area T2 and upstream from the deformation area F relative to a direction of rotation of the roller 36.

Figure 9:
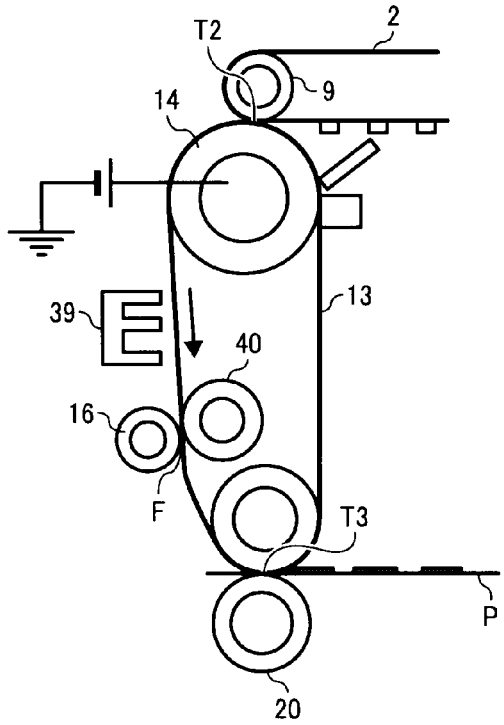
FIG. 9 is a schematic view illustrating a sixth example embodiment of the intermediate transfer device used for the image forming apparatus illustrated in FIG. 1.

FIG. 9 is a schematic view illustrating a sixth example embodiment of the intermediate transfer device 12 used for the color copier CCM1 illustrated in FIG. 1, which contains an induction heater configured to heat a secondary intermediate transfer member.

In FIG. 9, the secondary intermediate transfer belt 13 serves as the secondary intermediate transfer member. A rotatable member 40 is provided facing the deformation roller 16 with the secondary intermediate transfer belt 13 therebetween, so that the deformation area F is formed.

In FIGS. 8 and 9, heat radiated from the secondary intermediate transfer member (i.e., the roller 36 and the secondary intermediate transfer belt 13) has little effect on heating efficiency of the induction heater 39, because the induction heater 39 is provided on an outer side of the secondary intermediate transfer member.

In these embodiments, a metal layer serving as a heat generation layer and a silicone layer serving as an elastic layer are provided in this order on the secondary intermediate transfer member. In addition, a fluorocarbon resin layer serving as a release layer may be further provided thereon. The release layer prevents a toner image from adhering to the deformation roller 16 and the secondary intermediate transfer member at the recording transfer area T3. Further, the release layer improves transfer performance of a toner image onto a recording medium.

In these embodiments employing an induction heater, the secondary intermediate transfer member generates heat by itself at an immediately upstream side from the deformation area F relative to a direction of rotation of the secondary intermediate transfer member. Accordingly, there is no need to heat the secondary intermediate transfer member by contacting a heating member, resulting in energy saving.

Further, as the metal layer serving as a heating layer becomes thinner, heating speed increases. Therefore, the secondary intermediate transfer member can rotate at a higher speed. In other words, high-speed printing can be realized. Moreover, such a configuration decreases heat capacity of the secondary intermediate transfer member, and therefore the secondary intermediate transfer member is easily cooled when contacting a recording medium at the recording transfer area T3. Accordingly, there is an advantage that components provided around the secondary transfer area T2 are hardly heated.

When the secondary intermediate transfer member generates heat by itself, in other words, is heated by a non-contact method, the secondary intermediate transfer member is efficiently heated. Accordingly, a toner image is efficiently heated with less energy.

Figure 10:
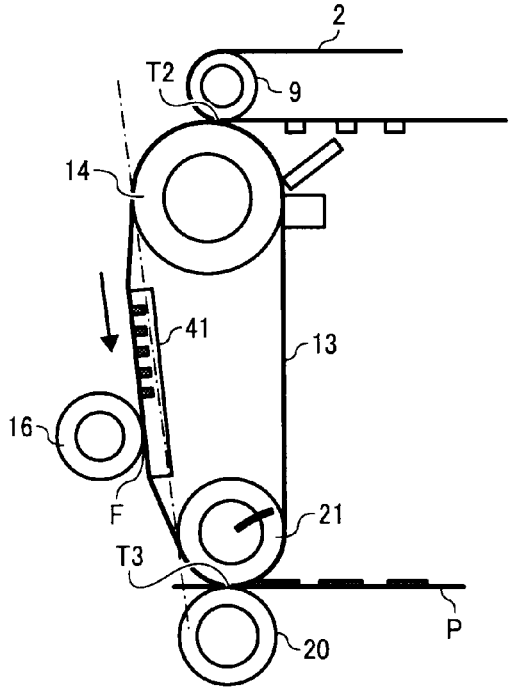
FIG. 10 is a schematic view illustrating a seventh example embodiment of the intermediate transfer device used for the image forming apparatus illustrated in FIG. 1.

FIG. 10 is a schematic view illustrating a seventh example embodiment of the intermediate transfer device 12 used for the color copier CCM1 illustrated in FIG. 1, which contains a plane heater configured to heat a secondary intermediate transfer member.

In FIG. 10, a plane heater 41 is provided so as to contact an inner surface of the secondary intermediate transfer belt 13. A contact surface of the plane heater 41 with the secondary intermediate transfer belt 13 is located on an outer side of a tangent line between the secondary transfer roller 14 and the recording transfer roller 21.

In the present embodiment, the plane heater 41 includes ceramic heaters. The ceramic heaters are provided in contact with the secondary intermediate transfer belt 13 at a downstream side from the secondary transfer area T2 and an upstream side from the deformation area F relative to a direction of rotation of the secondary intermediate transfer belt 13. The deformation roller 16 presses the plane heater 41 with the secondary intermediate transfer belt 13 therebetween to form the deformation area F, while no ceramic heater is provided on a contact point of the deformation roller 16 with the plane heater 41.

In the present embodiment, a shorter time is needed for heating the secondary intermediate transfer belt 13 using the plane heater 41, resulting in energy saving. In addition, the heating area of the plane heater 41 is easily lengthened, so that a toner image is easily heated, softened, and deformed.

Further, in the present embodiment, a toner image is previously heated before compression with a plane surface. Therefore, the deformation rate may increase, and a higher toner area ratio may be achieved with lesstoner. Alternatively, a rotatable member may be provided so as to face the deformation roller 16 with the secondary intermediate transfer belt 13 therebetween, so that the deformation area F is formed on a downstream side from the plane heater 41 relative to a direction of rotation of the secondary intermediate transfer belt 13. In this case, however, there is a concern for cost increase.

Figure 11:
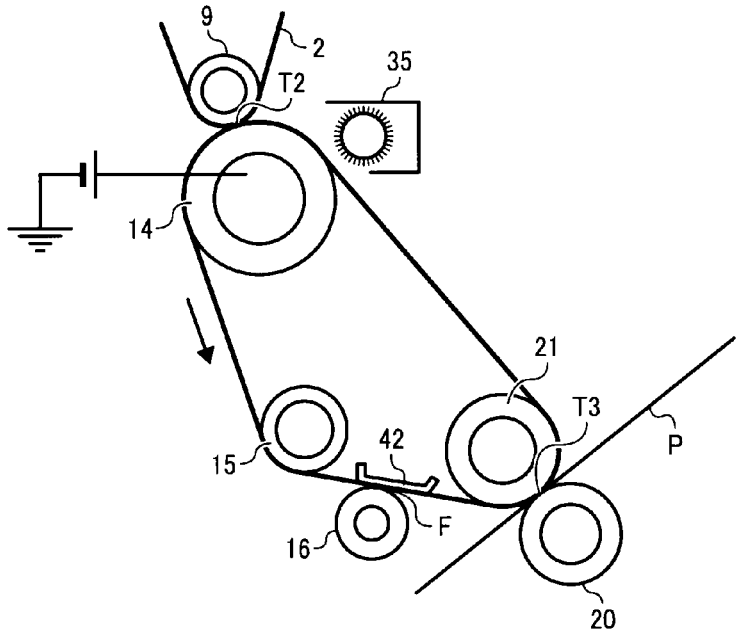
FIG. 11 is a schematic view illustrating an eighth example embodiment of the intermediate transfer device used for the image forming apparatus illustrated in FIG. 1.

FIG. 11 is a schematic view illustrating an eighth example embodiment of the intermediate transfer device 12 used for the color copier CCM1 illustrated in FIG. 1, which may also be considered a variation of the seventh example embodiment illustrated in FIG. 10.

In FIG. 11, a plane member 42 is provided so as to face the deformation roller 16 with the secondary intermediate transfer belt 13 therebetween, so that the deformation area F is formed. Such a configuration lengthens deformation time of a toner image. Accordingly, a higher toner area ratio may be achieved with less toner.

The foregoing example embodiments are applicable to image forming apparatuses having a configuration such as the CCM1 illustrated in FIG. 1. The following is a description for another example embodiment of an image forming apparatus which deforms a toner image without adversely affecting other components by application of heat.

Figure 12:
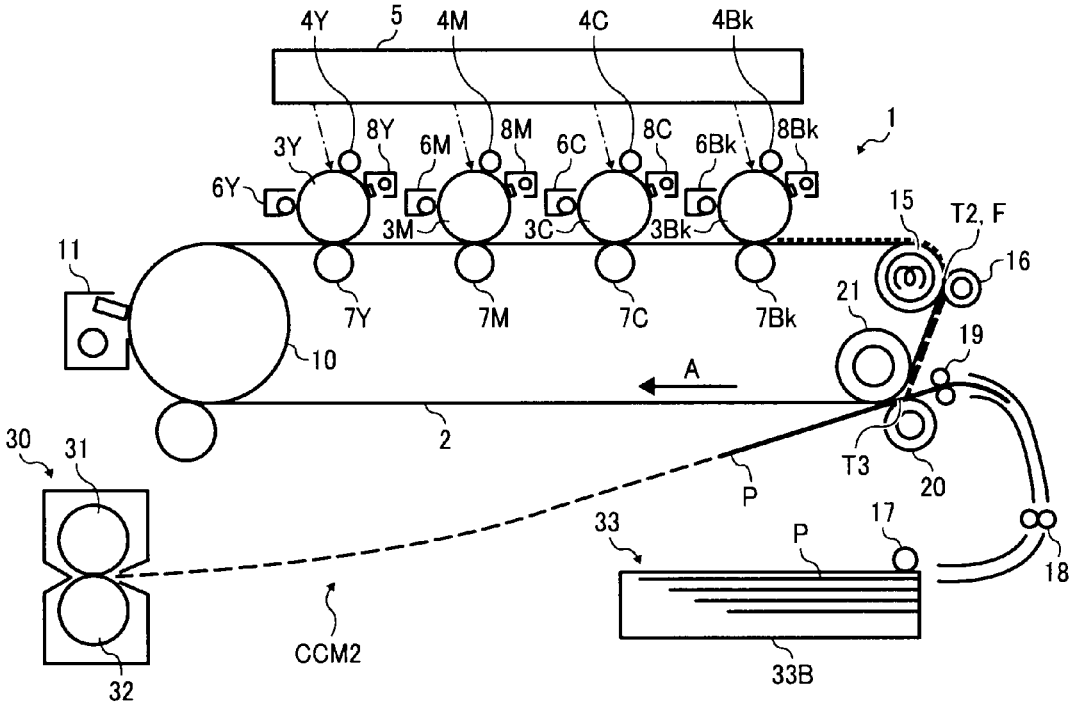
FIG. 12 is a schematic view illustrating another example embodiment of an image forming apparatus of the present invention.

FIG. 12 is a schematic view illustrating another example embodiment of a tandem color copier as an image forming apparatus of the present invention.

A tandem color copier CCM2 illustrated in FIG. 12 includes an image forming part 1 in the central part, and a paper feed part 33 beneath the image forming part. The image forming part 1 includes an intermediate transfer belt 2 having a transfer surface stretched in a horizontal direction. The intermediate transfer belt 2 is stretched taut by a recording transfer roller 21 also serving as a driving roller, a heating roller 15 containing a heater, and a driven roller 10, and is rotatable in a direction indicated by arrow A in FIG. 12.

Above the transfer surface of the intermediate transfer belt 2, drum-shaped photoconductors (i.e., image bearing members) 3Y, 3M, 3C, and 3Bk are arranged at specific intervals along a direction of movement of the intermediate transfer belt 2. Toner images of yellow, magenta, cyan, and black, which are complementary colors of color separation colors, are respectively formed on the photoconductors 3Y, 3M, 3C, and 3Bk (hereinafter "photoconductors 3" unless otherwise specified).

The photoconductors 3 are rotatable in the same direction, i.e., counterclockwise direction in FIG. 12. Charging devices 4Y, 4M, 4C, and 4Bk (hereinafter "charging devices 4"), a writing device 5, developing devices 6Y, 6M, 6C, and 6Bk (hereinafter "developing devices 6"), primary transfer rollers 7Y, 7M, 7C, and 7Bk (hereinafter"primary transfer rollers 7"), and cleaning devices 8Y, 8M, 8C, and 8Bk (hereinafter "cleaning devices 8") are provided around the photoconductors 3, respectively.

Each developing device 6 contains a toner having a color corresponding to a color of a latent image to be developed. A belt cleaning device 11 to clean the surface of the intermediate transfer belt 2 is provided so as to face the driven roller 10.

A deformation roller 16 is provided facing the heating roller 15 with the intermediate transfer belt 2 therebetween, so as to form a secondary transfer area T2. More specifically, a pressing member, not shown, presses the deformation roller 16 against the heating roller 15 to form a deformation area F on a downstream side from a contact starting point of the intermediate transfer belt 2 with the heating roller 15 relative to a direction of rotation of the intermediate transfer belt 2.

A pressing roller 20 is provided facing the recording transfer roller 21 with the intermediate transfer belt 2 therebetween, so as to form a recording transfer area T3. More specifically, a pressing member, not shown, presses the pressing roller 20 against the recording transfer roller 21 to form the recording transfer area T3 in which a toner image is transferred onto a recording medium P.

The recording medium P stored in a paper feed cassette 33B in the paper feed part 33 is conveyed to the recording transfer area T3 by a paper feed roller 17, a pair of conveyance rollers 18, and a pair of registration rollers 19. The toner image is transferred and fixed onto the recording medium P in the recording transfer area T3.

In the present embodiment, the transferred image may have a high glossiness. When the recording medium P has a rough surface, there may be a large difference in glossiness between image portions and background portions. Since the toner image adheres to only convex portions on the recoding medium P, the toner image may be easily scraped off. To obtain a reliable image, a greater amount of heat and/or pressure are needed in the present embodiment, in which a toner image is simultaneously transferred and fixed onto a recording medium in the recording transfer area T3, but with the risk of heat transfer to other components and a consequent shartning of component life.

According to the example embodiments described above, a toner image is heated after being transferred. The heated toner image conforms to convexities and concavities on the surface of a recording medium, and therefore there is little difference in glossiness between the resultant image portions and background portions. Glossiness is controllable by controlling temperature and pressure applied to the toner image. Since the toner image is previously deformed into a thin layer in the recording transfer area, the toner image is easily deformed by heating. Therefore, the toner image can be fixed on a recording medium with a lower temperature and pressure. Accordingly, less heat transfers to components in contact with the secondary intermediate transfer belt 13, thereby preventing toner aggregation. Further, less pressure is applied to the components, thereby preventing deterioration of durability.

Figure 13:
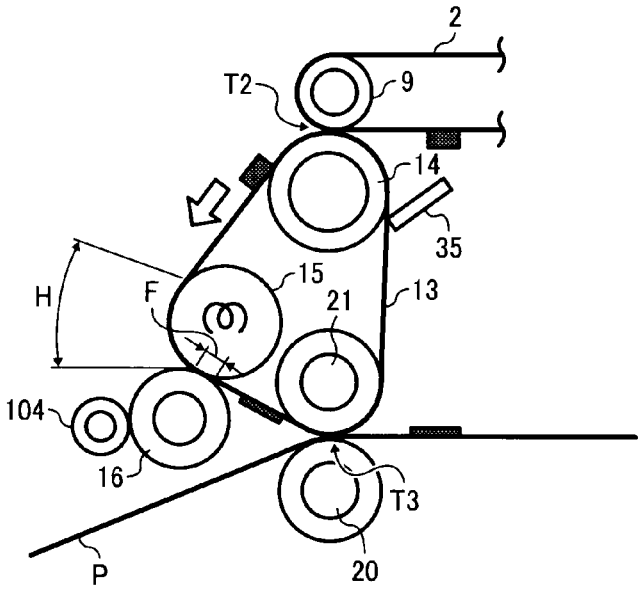
FIG. 13 is a schematic view illustrating a ninth example embodiment of the intermediate transfer device used for the image forming apparatus illustrated in FIG. 1.

FIG. 13 is a schematic view illustrating a ninth example embodiment of the intermediate transfer device 12 used for the color copier CCM1 illustrated in FIG. 1.

In FIG. 13, an excessive heat transfer member 104 configured to transfer excessive heat from the deformation roller 16 is further provided.

The excessive heat transfer member 104 may be a heat pipe, for example. The excessive heat transfer member 104 is provided adjacent to or in contact with the deformation roller 16, thereby transferring excessive heat from the deformation roller 16 to the excessive heat transfer member 104.

Since the excessive heat transfer member 104 is provided adjacent to or in contact with the deformation roller 16, the deformation roller 16 is prevented from being excessively heated. Therefore, the temperature of the deformation roller 16 is kept lower than that of the secondary intermediate transfer belt 13. Accordingly, the adherence of the toner image to the secondary intermediate transfer belt 13 is kept larger than that to the deformation roller 16.

When the excessive heat transfer member 104 is provided adjacent to (i.e., not in contact with) the deformation roller 16, the deformation roller 16 is prevented from being abraded. Accordingly, high quality images can be produced for an extended period of time.

When the excessive heat transfer member 104 is provided in contact with the deformation roller 16, heat is much more effectively transferred from the deformation roller 16. Accordingly, the toner image is reliably prevented from adhering to the deformation roller 16.

Figure 14:
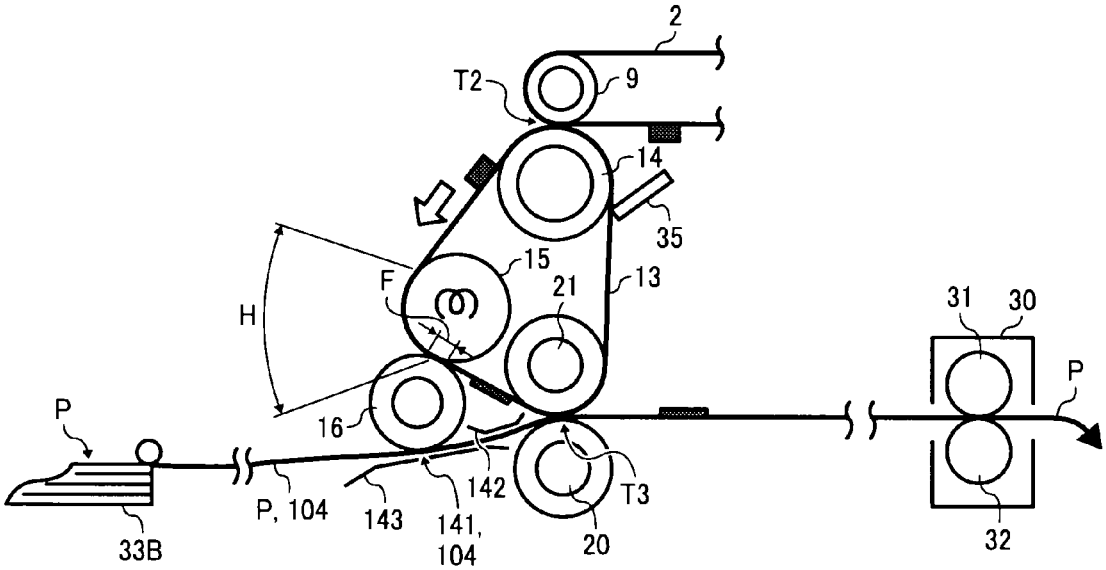
FIG. 14 is a schematic view illustrating a tenth example embodiment of the intermediate transfer device used for the image forming apparatus illustrated in FIG. 1.

FIG. 14 is a schematic view illustrating a tenth example embodiment of the intermediate transfer device 12 used for the color copier CCM1 illustrated in FIG. 1.

In FIG. 14, the recording medium P also serves as the excessive heat transfer member 104.

The recording medium P is fed from the paper feed cassette 33B to the recording transfer area T3 through guide members 142 and 143, in synchronization with entry of the deformed toner image into the recording transfer area T3. The heated and deformed toner image is pressed against the recording medium P in the recording transfer area T3 so that the toner image is transferred onto the recording medium P. The recording medium P onto which the toner image is transferred is then conveyed to a nip formed between the fixing roller 31 and the pressing roller 32 in the fixing device 30 so that the toner image is fixed on the recording medium P.

The guide members 142 and 143 each comprise a metallic plate having a length corresponding to the maximum size of the recording medium P. The guide members 142 and 143 are attached to the main body of the image forming apparatus so as to form a conveyance path 141 configured to convey the recording medium P, also serving as the excessive heat transfer member 104, to the recording transfer area T3.

The recording medium P is conveyed to between the guide member 143 and the deformation roller 16, and subsequently conveyed to the recording transfer area T3 while the guide member 142 prevents the recording medium P from contacting the secondary intermediate transfer belt 13.

The recording medium P, serving as the excessive heat transfer member 104, is adjacent to or in contact with the deformation roller 16 while being conveyed, thereby transferring excessive heat from the deformation roller 16 to the recording medium P and the conveyance path 141.

Since the recording medium P and the conveyance path 141, both serving as the excessive heat transfer member 104, are adjacent to or in contact with the deformation roller 16, the deformation roller 16 is prevented from being excessively heated. Therefore, the temperature of the deformation roller 16 is kept lower than that of the secondary intermediate transfer belt 13. Accordingly, the adherence of the toner image to the secondary intermediate transfer belt 13 is kept larger than that to the deformation roller 16.

In the present embodiment, the recording medium P also serves as the excessive heat transfer member 104, resulting in cost reduction. Further, since the recording medium P is previously heated, a temperature difference between the deformed toner image and the recording medium P is relatively small in the recording transfer area T3. Therefore, the temperature of the toner image may not rapidly decrease when the toner image is transferred onto the recording medium P in the recording transfer area T3. Accordingly, the toner image transferred onto the recording medium P is in soft state, resulting in strong adherence of the toner image to the recording medium P and high transfer performance.

Figure 15:
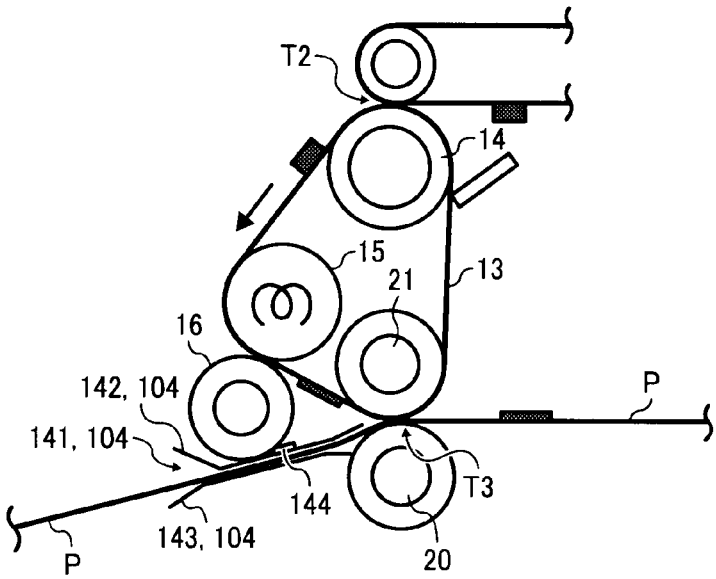
FIG. 15 is a schematic view illustrating an eleventh example embodiment of the intermediate transfer device used for the image forming apparatus illustrated in FIG. 1.

FIG. 15 is a schematic view illustrating an eleventh example embodiment of the intermediate transfer device 12 used for the color copier CCM1 illustrated in FIG. 1.

In FIG. 15, the guide members 142 and 143 also serve as the excessive heat transfer member 104, and are provided adjacent to or in contact with the deformation roller 16. The guide member 142 further includes a protection member 144 configured to protect a contact surface of the guide member 142 with the deformation roller 16, provided in contact with the deformation roller 16. The protection member 144 includes a felt member including a thermal conductivity improver.

The guide members 142 and 143, configured to convey the recording medium P to the recording transfer area T3, include a metallic plate having a length corresponding to the maximum size of the recording medium P. The guide members 142 and 143 are provided facing each other at a predetermined distance apart. The conveyance guide 141 is formed so that a leading edge of the recording medium P is conveyed to the recording transfer area T3 without contacting the secondary intermediate transfer belt 13.

The recording medium P is conveyed to the recording transfer area T3 through the conveyance path 141 formed between the guide members 142 and 143, and subsequently the deformed toner image is transferred onto the recording medium P in the recording transfer area T3.

The guide member 142 is provided adjacent to or in contact with the deformation roller 16, thereby effectively transferring excessive heat from the deformation roller 16 to the guide member 142. Accordingly, excessive heat can be transferred from the deformation roller 16 without additional components.

In the tenth example embodiment illustrated in FIG. 14, in which the recording medium P serves as the excessive heat transfer member 104, heat transfer may vary by location of the recording medium P in an axial direction. In the present eleventh embodiment, this problem seldom occurs. The guide members 142 and 143 have high thermal conductivity because of including metallic materials. Therefore, excessive heat can be rapidly transferred to the guide members 142 and 143. Since the guide members 142 and 143 have a large surface area, heat can be effectively radiated therefrom, resulting in reliable heat transfer from the deformation roller 16.

Accordingly, the temperature of the deformation roller 16 is kept lower than that of the secondary intermediate transfer belt 13. Further, the guide members 142 and 143 effectively transfer heat to the recording medium and/or radiate heat when an airflow generates in the conveyance path 141 while conveying the recording medium P. Therefore, the guide members 142 and 143 are reliably cooled.

The cooling of the guide members 142 and 143 enables the deformation roller 16 to reliably transfer excessive heat thereto, and therefore the temperature of the deformation roller 16 is reliably kept lower than that of the secondary intermediate transfer belt 13.

Accordingly, the toner image is prevented from adhering to the deformation roller 16, so that high quality images are consistently provided. By transferring excessive heat to the recording medium P, transfer performance of the toner image onto the recording medium also improves.

The protection member 144 is provided on a contact surface of the guide member 142 with the deformation roller 16 so as not to make any flaw on the contact surface of the guide member 142. The protection member 144 preferably includes a felt member including carbon, etc., to have a high thermal conductivity.

Figure 16:
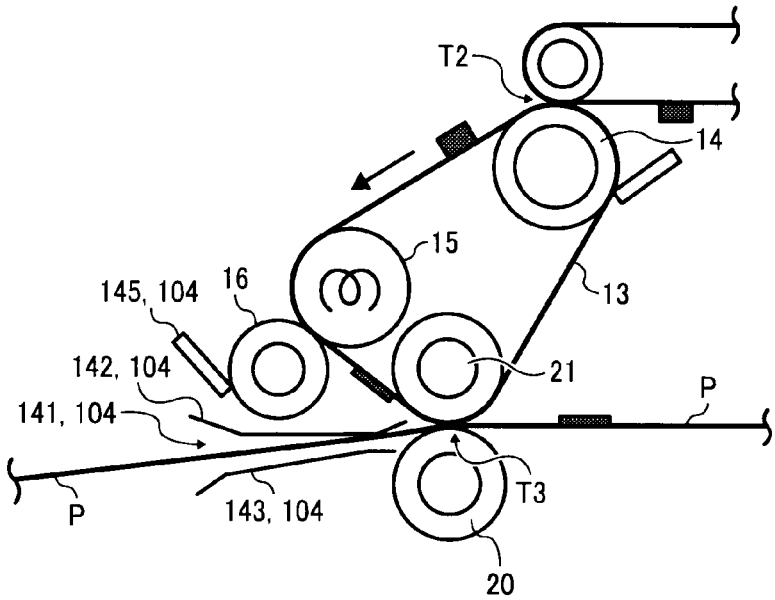
FIG. 16 is a schematic view illustrating a twelfth example embodiment of the intermediate transfer device used for the image forming apparatus illustrated in FIG. 1.

FIG. 16 is a schematic view illustrating a twelfth example embodiment of the intermediate transfer device 12 used for the color copier CCM1 illustrated in FIG. 1.

In FIG. 16, a cleaning member 145 configured to clean the surface of the deformation roller 16 is further provided. Not only the guide members 142 and 143 but also the cleaning member 145 serve as the excessive heat transfer member 104. Therefore, excessive heat can be transferred from the deformation roller 16 to the cleaning member 145.

Accordingly, the temperature of the deformation roller 16 is kept lower than that of the secondary intermediate transfer belt 13. Since the cleaning member 145 also serves as the excessive heat transfer member 104, the toner image is prevented from adhering to the deformation roller 16. Accordingly, high quality images are reliably provided at low cost.

Figure 17:
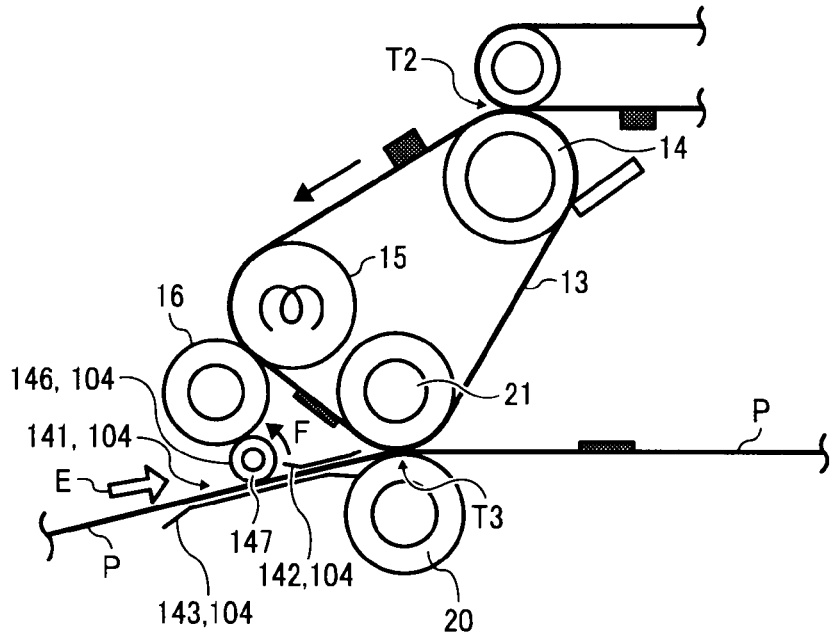
FIG. 17 is a schematic view illustrating a thirteenth example embodiment of the intermediate transfer device used for the image forming apparatus illustrated in FIG. 1.

FIG. 17 is a schematic view illustrating a thirteenth example embodiment of the intermediate transfer device 12 used for the color copier CCM1 illustrated in FIG. 1.

In FIG. 17, the excessive heat transfer member 104 further includes a rotatable member 146 provided adjacent to or in contact with the deformation roller 16.

The guide members 142 and 143 are provided at a predetermined interval beneath the rotatable member 146 so as to form the conveyance path 141. The rotatable member 146 rotates so as to follow the direction of rotation of the deformation roller 16.

Since the whole surface of the rotatable member 146 is adjacent to or in contact with the deformation roller 16, the adjacency or contact surface of the rotatable member 146 to/with the deformation roller 16 is relatively large. Accordingly, a large amount of excessive heat can be transferred from the deformation roller 16 to the rotatable member 146.

Further, excessive heat from the deformation roller 16 is also transferred to the guide members 142 and 143 when the recording medium P is conveyed to the conveyance path 141, as well as the foregoing example embodiments. Accordingly, the temperature of the deformation roller 16 is kept low.

The rotatable member 146 rotates in a direction indicated by arrow F in FIG. 17, which is the same direction as a direction of conveyance of the recording medium P indicated by arrow E in FIG. 17. The rotatable member 146 is in contact with the guide member 143 so as to reliably contact the recording medium P to reliably transfer excessive heat to the recording medium P. Accordingly, the temperature of the rotatable member 146 is kept low and transfer performance in the recording transfer area T3 improves.

The rotatable member 146 further includes an elastic surface layer 147 made of a silicone rubber, etc. The elastic surface layer 147 is softer than the surface of the deformation roller 16. Therefore, the rotatable member 146 contacts the deformation roller 16 with a large contact width. Accordingly, a large amount of excessive heat can be transferred from the deformation roller 16 to the rotatable member 146, and the temperature of the deformation roller 16 is kept low.

Figure 18:
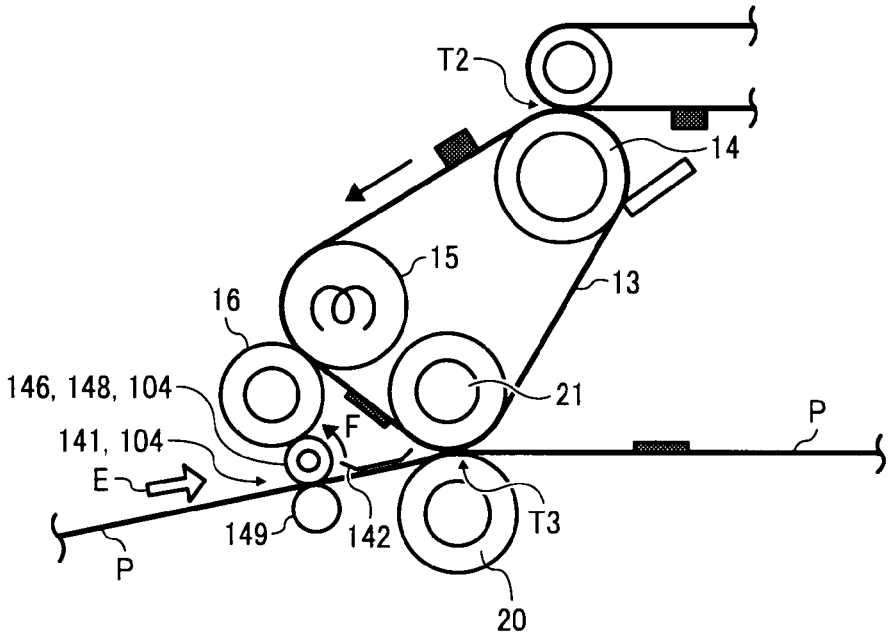
FIG. 18 is a schematic view illustrating a fourteenth example embodiment of the intermediate transfer device used for the image forming apparatus illustrated in FIG. 1.

FIG. 18 is a schematic view illustrating a fourteenth example embodiment of the intermediate transfer device 12 used for the color copier CCM1 illustrated in FIG. 1.

In FIG. 18, the rotatable member 146 serves as a conveyance roller 148 configured to convey the recording medium P in a direction indicated by arrow E in FIG. 18. Another conveyance roller 149 is provided so as to contact and press the conveyance roller 148. The contact point of the conveyance roller 148 with the conveyance roller 149 forms the conveyance path 141 configured to convey the recording medium P to the recording transfer area T3.

In the present embodiment, the rotatable member 146 also serves as the conveyance roller 148, which reliably contacts the recording medium P. Therefore, heat is reliably transferred from the rotatable member 146 to the recording medium P. Accordingly, the temperature of the deformation roller 16 is kept low and transfer performance in the recording transfer area T3 improves.

The excessive heat transfer members 104 described in the foregoing example embodiments, such as the recording medium P, the guide member 142, and the rotatable member 146, each are provided adjacent to or in contact with the deformation roller 16, so that excessive heat from the deformation roller 16 is transferred to the excessive heat transfer members 104. Accordingly, the temperature of the deformation roller 16 is kept lower than that of the secondary intermediate transfer belt 13, thereby preventing the toner image from adhering to the deformation roller 16.

Further, the excessive heat transfer members 104 described in the foregoing example embodiments, such as the recording medium P, the guide member 142, and the rotatable member 146, each have a larger thermal conductivity than the surface member of the deformation roller 16. Therefore, excessive heat from the deformation roller 16 is reliably and rapidly transferred to the excessive heat transfer member 104. Accordingly, the temperature of the deformation roller 16 is kept lower than that of the secondary intermediate transfer belt 13.

Moreover, the excessive heat transfer members 104 described in the foregoing example embodiments, such as the recording medium P, the guide member 142, and the rotatable member 146, each have a larger thermal capacity than the deformation roller 16. Therefore, excessive heat from the deformation roller 16 is reliably transferred to the excessive heat transfer member 104. Accordingly, the temperature of the deformation roller 16 is kept lower than that of the secondary intermediate transfer belt 13.

In addition, the conveyance roller 148 serving as the excessive heat transfer member 104 has a smaller surface hardness than the deformation roller 16. Therefore, the conveyance roller 148 contacts the deformation roller 16 with a large contact area, and a large amount of excessive heat can be transferred from the deformation roller 16 to the conveyance roller 148. Accordingly, the temperature of the deformation roller 16 is kept lower than that of the secondary intermediate transfer belt 13. Similarly, the conveyance roller 148 also contacts the recording medium P with a large contact area, and a large amount of excessive heat can be transferred to the recording medium P. Accordingly, transfer performance in the recording transfer area T3 improves.

Figure 19:
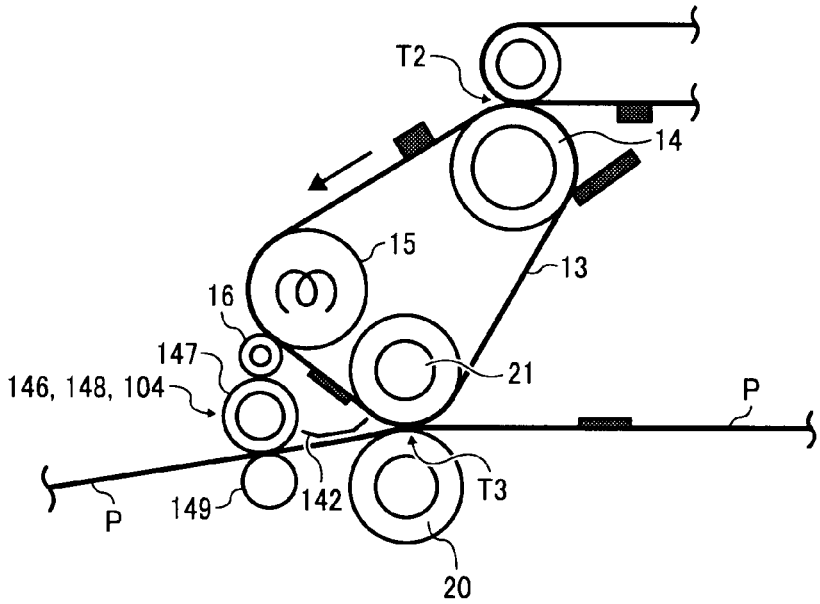
FIG. 19 is a schematic view illustrating a fifteenth example embodiment of the intermediate transfer device used for the image forming apparatus illustrated in FIG. 1.

FIG. 19 is a schematic view illustrating a fifteenth example embodiment of the intermediate transfer device 12 used for the color copier CCM1 illustrated in FIG. 1.

In FIG. 19, the rotatable member 146 has a larger diameter than the deformation roller 16.

The rotatable member 146 having a larger diameter than the deformation roller 16 further includes the elastic surface layer 147. Therefore, the rotatable member 146 has a larger thermal capacity than the deformation roller 16. Accordingly, excessive heat from the deformation roller 16 is easily and reliably transferred to the rotatable member 146.

The surface elastic layer 147 further accelerates excessive heat transfer. Since the rotatable member 146 also serves as the conveyance member 148 conveying the recording medium P, excessive heat is further transferred to the recording medium P.

Accordingly, the temperature of the deformation roller 16 is kept lower than that of the secondary intermediate transfer belt 13, while the temperature of the recording medium P is kept high. Such a configuration prevents the toner image from adhering to the deformation roller 16 and improves transfer performance, providing high quality images.

Figure 20:
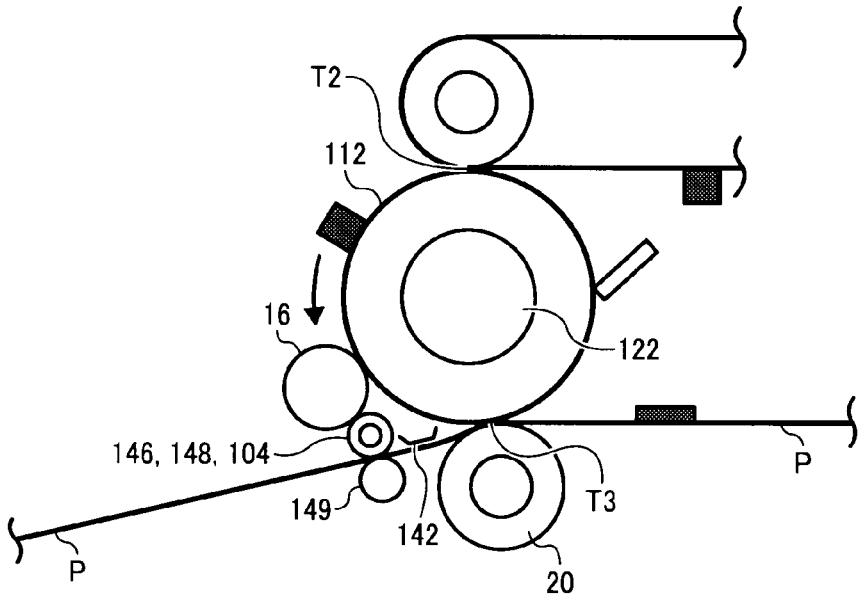
FIG. 20 is a schematic view illustrating a sixteenth example embodiment of the intermediate transfer device used for the image forming apparatus illustrated in FIG. 1.

FIG. 20 is a schematic view illustrating a sixteenth example embodiment of the intermediate transfer device 12 used for the color copier CCM1 illustrated in FIG. 1.

In FIG. 20, the secondary intermediate transfer belt 13 is replaced with a secondary intermediate transfer roller 112. The secondary intermediate transfer roller 112 contains an induction heater 122.

It is to be noted that the secondary intermediate transfer member is not limited to the secondary intermediate transfer belt 13, and the heater is not limited to a halogen heater. Accordingly, any heater that can heat the secondary intermediate transfer member from an inner side thereof may be used. For example, the induction heater 122, which generates heat by itself, directly heats the secondary intermediate transfer roller 112 so that the temperature of a surface contacting the toner image rapidly increases.

The transfer devices according to example embodiments of the present invention evenly transfer a toner image onto a recording medium without adversely affecting other performances of the image forming apparatus. Further, such transfer devices have high durability and consume less energy, resulting in energy saving and low cost.

Having now fully described the invention, it will be apparent to one of ordinary skill in the art that many changes and modifications can be made thereto without departing from the spirit and scope of the invention as set forth therein.

What is claimed is:

1. An intermediate transfer device, comprising:

an intermediate transfer member;

an intermediate transfer area defined between an image bearing member and the intermediate transfer member and configured to transfer a toner image from the image bearing member onto the intermediate transfer member;

a heating member configured to heat the intermediate transfer member by applying heat to the toner image thereon;

a deformation member configured to apply pressure to the heated toner image on the intermediate transfer member; and a recording transfer area defined between the intermediate transfer member and a pressing member pressed against the intermediate transfer member and configured to transfer the compressed toner image from the intermediate transfer member onto a recording medium, wherein the intermediate transfer member is disposed between the deformation member and the heating member.

2. The intermediate transfer device according to claim 1, wherein the heating member heats the intermediate transfer member from an inner side thereof.

3. The intermediate transfer device according to claim 1, wherein the heating member is disposed within the intermediate transfer member, and generates heat by itself.

4. The intermediate transfer device according to claim 1, wherein the heating member heats the intermediate transfer member at a downstream side from the intermediate transfer part and an upstream side from the recording transfer part relative to a direction of rotation of the intermediate transfer member.

5. The intermediate transfer device according to claim 4, wherein the heating member heats the intermediate transfer member at a downstream side from the intermediate transfer part and an upstream side from a contact part of the intermediate transfer member with the deformation member relative to a direction of rotation of the intermediate transfer member.

6. The intermediate transfer device according to claim 1, wherein the intermediate transfer member has a smaller surface hardness than the deformation member.

7. The intermediate transfer device according to claim 1, wherein surface layers of the intermediate transfer member and the deformation member each include a release material.

8. The intermediate transfer device according to claim 1, wherein the intermediate transfer member has a smaller surface roughness than the deformation member.

9. The intermediate transfer device according to claim 1, wherein the intermediate transfer member comprises a belt which is heated from an inner side thereof.

10. The intermediate transfer device according to claim 1, wherein the intermediate transfer member comprises a roller which is heated from an inner side thereof.

11. An image forming apparatus, comprising:

an image bearing member configured to bear a toner image;

an intermediate transfer device comprising:

an intermediate transfer member;

an intermediate transfer area defined between an image bearing member and the intermediate transfer member and configured to transfer the toner image from the image bearing member onto the intermediate transfer member;

a heating member configured to heat the intermediate transfer member by applying heat to the toner image thereon;

a deformation member configured to apply pressure to the heated toner image on the intermediate transfer member; and a recording transfer area defined between the intermediate transfer member and a pressing member pressed against the intermediate transfer member and configured to transfer the compressed toner image from the intermediate transfer member onto a recording medium; and a heating device configured to heat the recording medium having the toner image thereon, wherein the intermediate transfer member is disposed between the deformation member and the heating member.

12. An intermediate transfer device, comprising:

an intermediate transfer member onto which a toner image is transferred, the intermediate transfer member being movable;

a heating member configured to apply heat to the toner image on the intermediate transfer member;

a deformation member configured to apply pressure to the heated toner image on the intermediate transfer member to deform the toner image, the deformation member being rotatable; and an excessive heat transfer member configured to transfer excessive heat from the deformation member.

13. The intermediate transfer device according to claim 12, wherein the intermediate transfer member comprises a secondary transfer part configured to transfer the toner image onto the intermediate transfer member.

14. The intermediate transfer device according to claim 12, wherein the intermediate transfer member comprises a recording transfer part configured to transfer the deformed toner image onto a recording medium.

15. The intermediate transfer device according to claim 12, wherein the intermediate transfer member comprises a secondary intermediate transfer belt in contact with the deformation member.

16. The intermediate transfer device according to claim 12, wherein the intermediate transfer member comprises a secondary intermediate transfer roller in contact with the deformation member.

17. The intermediate transfer device according to claim 12, wherein the intermediate transfer member comprises a heat generating member.

18. The intermediate transfer device according to claim 17, wherein the heat generating member comprises an electromagnetic induction heating device.

19. The intermediate transfer device according to claim 12, wherein the intermediate transfer member has a multilayer structure in which an outermost layer is an elastic layer.

20. The intermediate transfer device according to claim 19, wherein the elastic layer comprises a silicone rubber having a thickness of from 0.05 to 0.5 mm.

* * * * *